US011352853B2

(12) United States Patent
Maddux et al.

(10) Patent No.: US 11,352,853 B2
(45) Date of Patent: Jun. 7, 2022

(54) WELLBORE FLUID COMMUNICATION TOOL

(71) Applicant: Halliburton Energy Services, Inc., Houston, TX (US)

(72) Inventors: Stephen Ross Maddux, Carrollton, TX (US); Gary Kohn, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 879 days.

(21) Appl. No.: 16/079,893

(22) PCT Filed: Aug. 3, 2017

(86) PCT No.: PCT/US2017/045330
§ 371 (c)(1),
(2) Date: Aug. 24, 2018

(87) PCT Pub. No.: WO2019/027464
PCT Pub. Date: Feb. 7, 2019

(65) Prior Publication Data

US 2021/0189835 A1 Jun. 24, 2021

(51) Int. Cl.
*E21B 34/14* (2006.01)
*E21B 33/13* (2006.01)
*E21B 34/06* (2006.01)

(52) U.S. Cl.
CPC ..... *E21B 34/142* (2020.05); *E21B 33/13* (2013.01); *E21B 34/063* (2013.01); *E21B 2200/06* (2020.05)

(58) Field of Classification Search
CPC ..... E21B 34/124; E21B 34/063; E21B 33/13; E21B 2200/06
See application file for complete search history.

(56) References Cited

U.S. PATENT DOCUMENTS 4,280,561 A 7/1981 Fredd
2009/0014185 A1* 1/2009 Franco ..... E21B 34/14 166/373

(Continued)

FOREIGN PATENT DOCUMENTS

WO WO-2015110463 A2 7/2015
WO WO-2018009191 A1 1/2018

OTHER PUBLICATIONS

Korean Intellectual Property Office, International Search Report and Written Opinion PCT/US2017/045330, dated Apr. 27, 2018, 16 pages, Korea.

*Primary Examiner* — Christopher J Sebesta
(74) *Attorney, Agent, or Firm* — Haynes and Boone, LLP

(57) ABSTRACT

A system and method directed to performing a single trip cementing operation at spaced out locations within a hydrocarbon zone during the construction of a wellbore using a wellbore fluid communication tool. In an embodiment, the tool is deployed on a tubular string above the hydrocarbon zone and comprises a housing including at least one radial port, a seal assembly, an outer sleeve assembly having a door assembly operable to translate across the seal assembly while closed, an inner mandrel and a seat assembly. The tool facilitates the placement of cement within a wellbore annulus from an uphole position in lieu of at the bottom of the wellbore thereby minimizing the pressure required to perform cementing job. At the same time, the ability for the door assembly to translate across the seal assembly while closed ensures the seal is not damaged from repetitive opening and closing of the door assembly.

20 Claims, 8 Drawing Sheets

(56) References Cited

U.S. PATENT DOCUMENTS

| | | | | |
|---|---|---|---|---|
| 2013/0048298 | A1* | 2/2013 | Merron | E21B 34/14 166/373 |
| 2013/0175040 | A1* | 7/2013 | Madero | E21B 34/14 166/332.1 |
| 2014/0048271 | A1 | 2/2014 | Coon et al. | |
| 2016/0115765 | A1* | 4/2016 | Braekke et al. | E21B 34/14 166/318 |
| 2016/0326836 | A1* | 11/2016 | Gonzalez | E21B 43/14 |
| 2017/0234105 | A1* | 8/2017 | Vasques | E21B 43/14 166/250.01 |

* cited by examiner

WELLBORE FLUID COMMUNICATION TOOL

CROSS-REFERENCE TO RELATED APPLICATIONS

This application is a U.S. national stage patent application of International Patent Application No. PCT/US2017/045330, filed on Aug. 3, 2017, the benefit of which is claimed and the disclosure of which is incorporated herein by reference in its entirety.

FIELD OF THE DISCLOSURE

The present disclosure relates generally to the construction of a wellbore. More specifically, the present disclosure relates to systems and methods for using a wellbore fluid completion tool to facilitate a single trip cementing operation during the construction of a wellbore.

BACKGROUND

The construction of a wellbore for the production of hydrocarbons, in many instances, requires drilling the wellbore hundreds if not thousands of feet deep to reach hydrocarbon producing zones. Typically, a primary cementing operation may be performed as a part of the wellbore construction process. The primary cementing operation is most commonly performed by pumping cement through a tubular string to the bottom of a casing section and then up a wellbore annulus to create a cement barrier within the wellbore between the casing section and the wellbore wall. The cement barrier may serve a number of functions such as preventing fluid communication between producing zones or protecting the casing section against corrosion by formation fluids.

Due to the depth at which the casing sections may be installed, the primary cementing operations may require the use of extremely high pressures in order to deliver the cement through the tubular string and to the wellbore annulus. Such pressures could result in unintended fracturing of the bottom hole formation. A common approach for preventing this problem is to drill the wellbore and install casing in segments, running the tubular string in the wellbore multiple times to perform the primary cementing operation. However, this approach is commonly viewed as inefficient from both a time and cost perspective. In order to address these concerns, a method for communicating with the annulus from top to bottom has been developed.

DESCRIPTION OF ILLUSTRATIVE EMBODIMENTS

Figure 1:
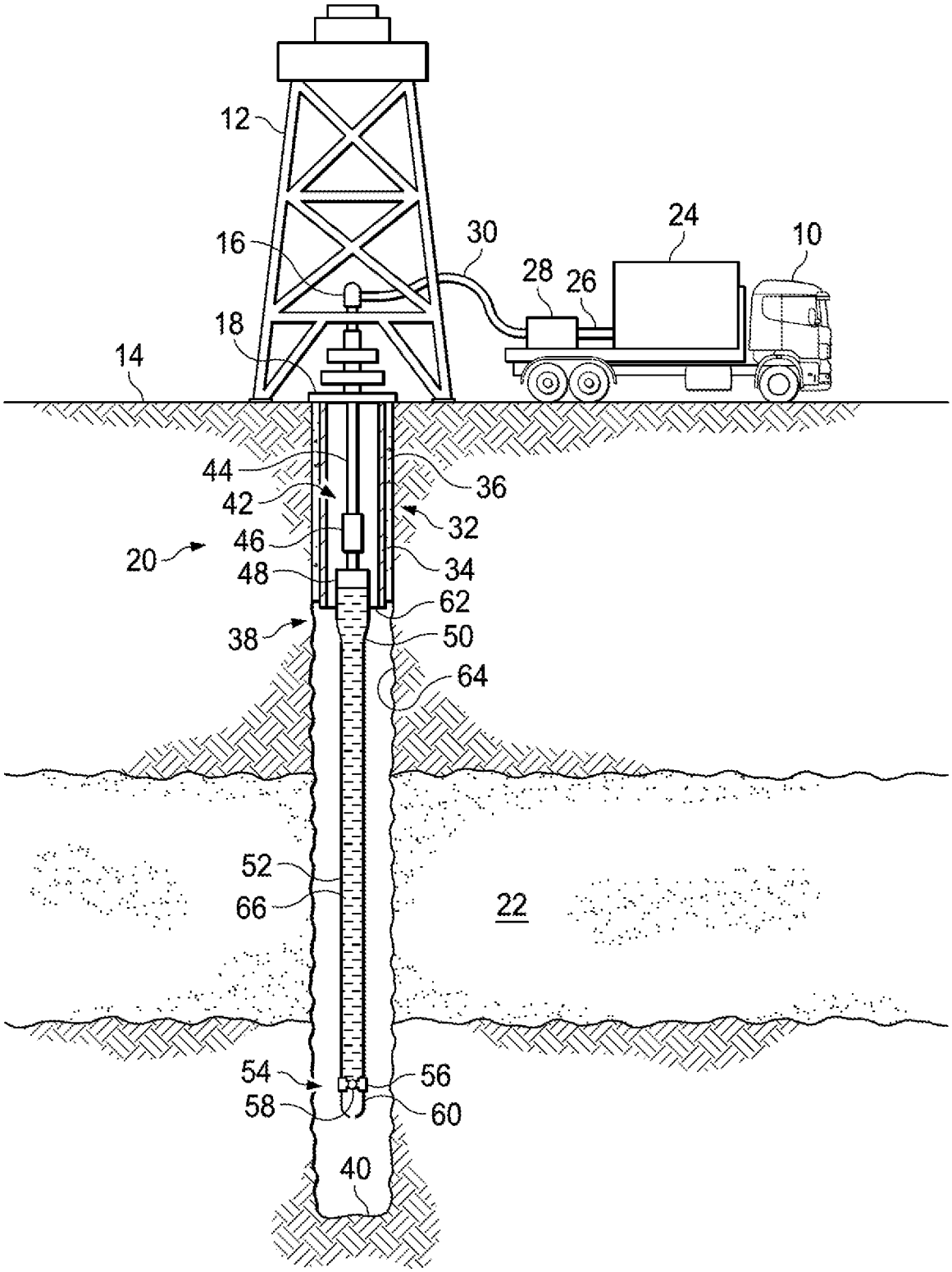
FIG. 1 depicts a schematic view of a single trip wellbore cementing operation performed in a wellbore during construction of the wellbore, according to one or more illustrative embodiments.

Embodiments of the present disclosure relate to using a wellbore fluid communication tool to perform a single trip wellbore cementing operation during the construction of a well. While the present disclosure is described herein with reference to illustrative embodiments for particular applications, it should be understood that embodiments are not limited thereto. Other embodiments are possible, and modifications can be made to the embodiments within the spirit and scope of the teachings herein and additional fields in which the embodiments would be of significant utility.

The disclosure may repeat reference numerals and/or letters in the various examples or figures. This repetition is for the purpose of simplicity and clarity and does not in itself dictate a relationship between the various embodiments and/or configurations discussed. Further, spatially relative terms, such as beneath, below, lower, above, upper, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure. Unless otherwise stated, the spatially relative terms are intended to encompass different orientations of the apparatus in use or operation in addition to the orientation depicted in the figures. For example, if an apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

As noted above, embodiments of the present disclosure relate to using a wellbore fluid communication tool to perform a single trip wellbore cementing operation during the construction of a well. Although the wellbore fluid communication tool is described herein in the context of a wellbore cementing operation, it is envisioned that the wellbore fluid communication tool may be utilized in any application where a valve may be actuated between closed and open positions and valve seal integrity must be maintained during the actuation of the valve. For instance, the wellbore fluid communication tool may be used as a diverter device to equalize pressure inside a tubular string and an area outside of the tubular string such as an annulus of a wellbore. Likewise, the wellbore fluid communication tool may be used as a valve in production operations, such as in a production string. In any event, with respect to generalized embodiments used in cementing operations, a system used to perform a single trip wellbore cementing operation in a wellbore may include a tubular string having a wellbore fluid communication tool, a liner hanger running tool, an expandable liner hanger, a liner and a float assembly. In one embodiment, the wellbore fluid communication tool may include: a housing having a central passage therethrough, the housing including at least one radial port between the central passage and a location external to the wellbore fluid communication tool; a seal assembly disposed along the central passage and adjacent to the radial port; an outer sleeve assembly disposed within the housing along the central passage, the outer sleeve assembly having a door assembly which includes first and second doors abutting one another to define a door gap, the door gap initially positioned upstream of the seal assembly; an inner mandrel having a radial orifice; and a first seat assembly disposed within the outer sleeve assembly and coupled to the inner mandrel. In an additional embodiment, the wellbore fluid communication tool may include a second seat assembly.

Referring to FIG. 1, a schematic view of a single trip wellbore cementing operation performed in a wellbore during construction of the wellbore is illustrated. Although the single trip wellbore cementing operation is presented in an onshore environment, the method and systems described herein may also be implemented in an offshore setting. In certain embodiments, the single trip wellbore cementing operation maybe implemented using a cement source, 10, such as cement truck, and a derrick 12 at the surface 14. The derrick 12 may be used to facilitate installation of a cementing head 16 and a wellhead 18 at the top of a wellbore 20 which has been drilled through a hydrocarbon zone 22. In an embodiment, the cement source 10 may include a cement tank 24, a suction line 26, a cement pump 28 and a feed line 30.

As further illustrated in FIG. 1, in certain embodiments, the wellbore 20 may include a partially cased section 32 in which a segment of casing 34 is secured by cement 36, and an open hole section 38 extending down to the wellbore bottom 40; however, in an alternative embodiment the wellbore 20 may not include a cased section 32. A tubular string 42 may be run into the wellbore 20 from the surface 14 to a position near the wellbore bottom 40. In a preferred embodiment, the tubular string 42 may include segments of drill pipe 44, a wellbore fluid communication tool 46, and a float assembly 54. The tubular string 42 may also include a liner hanger running tool 48, an expandable liner hanger 50 and a liner 52. In one or more embodiments, the wellbore fluid communication tool 46 may be a cementing tool. In certain embodiments, the float assembly 54 may include a float collar 56 with a back flow prevention valve 58 and a guide shoe 60. Placement of the tubular string 42 within the wellbore 20 forms an annulus 62 between the casing 34 and/or a wellbore wall 64 and the tubular string 42. In order to perform a single trip wellbore 20 cementing operation, the wellbore fluid communication tool 46 is positioned above the float assembly 54 at a first location and the float assembly 54 is spaced out and positioned below the wellbore fluid communication tool 46 on the tubular string 42 within the wellbore 20.

Upon placement of the tubular string 42 within the wellbore 20, the single trip cementing operation is performed in two phases: a primary cementing operation and a secondary cementing operation, which will be discussed with reference to the wellbore fluid communication tool 46 and FIGS. 2A-2F below. The primary cementing operation begins by using the cement pump 28 to draw cement from the cement tank 24 using the suction line 26. The cement pump 28 is then used to discharge cement into the cementing head 16 through the feed line 30. The cementing head 16 injects the cement through the wellhead 18 and the tubular string 42 where it discharges adjacent the wellbore bottom 40 through the guide shoe 60 of the float assembly 54. Injection of cement within the tubular string 42 is terminated when the desired area of the wellbore 20 is filled with cement. For example, it might be desirable to cement below the hydrocarbon zone 22 (not shown). Thereafter, in certain embodiments, a wiper plug (not shown) may be deployed through the tubular string 42 to remove any remaining cement until coming to rest in the float collar 56 of the float assembly 54, effectively sealing the bottom of the liner 52. Subsequently, in some embodiments, a volume of a spotting fluid 66 is injected through the tubular string 42 to fill the liner 52. The spotting fluid 66 preferably has fluid properties which prevent the cement from fully mixing with the spotting fluid 66. As such, the spotting fluid 66 will preferably settle out of the cement when the cement and spotting fluid 66 are disposed within a closed volume. For example, in an embodiment, the spotting fluid 66 may have a higher density than that of the cement used in the single trip cementing operation described herein.

Figure 2A:
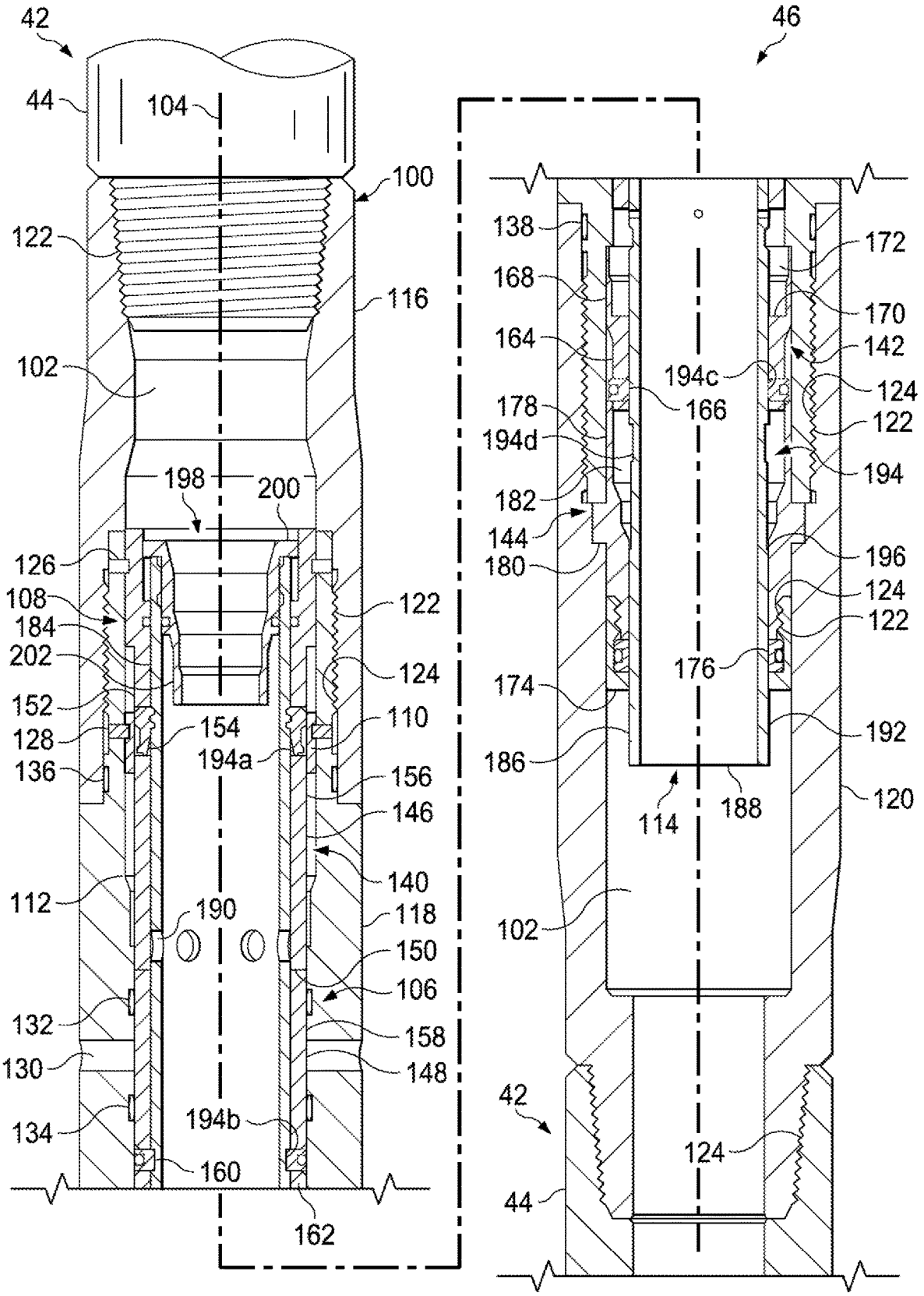
FIG. 2A depicts a cross-sectional view of a first configuration of a closed wellbore fluid communication tool used in a single trip wellbore cementing operation, according to one or more illustrative embodiments.

FIG. 2A depicts a cross-sectional view of a first configuration of a closed wellbore fluid communication tool 46 as run into the wellbore 20 on the tubular string 42. (See FIG. 1). The term "closed" as used herein, with respect to the wellbore fluid communication tool 46, indicates that various components of the wellbore fluid communication tool 46 are configured to prevent fluid communication between the interior and exterior of the wellbore fluid communication tool 46. The wellbore fluid communication tool 46 is used to facilitate the second phase (i.e., the secondary cementing operation) of the single trip cement operation, in which cement enters the annulus 62 of the wellbore 20 through the wellbore fluid communication tool 46 at a location upstream from the wellbore bottom 40 and flows down towards the wellbore bottom 40. Described in another manner, the wellbore fluid communication tool 46 facilitates the introduction of cement into the wellbore 20 during a secondary cementing operation from a location that is uphole of the location of where cement was introduced into the wellbore 20 during the primary cementing operation. This type of operation is in contrast with conventional cementing operations, which are more closely akin to only the primary cementing operation described herein, that would, in a similar configuration; require injecting cement from the surface 14, through the tubular string 42 within the wellbore 20 and out of the guide shoe 60 of the float assembly 54 near the wellbore bottom 40 and back up the annulus 62 of the wellbore 20. Depending on the depth of the wellbore 20, conventional cementing operations require extremely high pressures to circulate the cement back up the annulus 62 of the wellbore 20, which could potentially fracture the hydrocarbon zone 22 or alternatively require multiple cementing runs in the wellbore 20 to minimize the required pressure.

As illustrated in FIG. 2A, the wellbore fluid communication tool 46, includes a housing 100, which defines a central passage 102 that facilitates fluid communication with the drill pipe 44 of the tubular string 42 along a longitudinal axis 104. The wellbore fluid communication tool 46 may further include a seal assembly 106, an outer sleeve assembly 108, an intermediate housing ring 110, an intermediate housing ring stop 112 and an inner mandrel 114, which are disposed along central passage 102. As discussed further herein, the wellbore fluid communication tool 46 is opened, closed and sealed through a series of axial movements by the outer sleeve assembly 108 and the inner mandrel 114 within the housing 100 along the longitudinal axis 104.

In certain embodiments, housing 100 may have an upper housing section 116, an intermediate housing section 118 and a lower housing section 120; however, in certain embodiments the housing 100 may be formed as a continuous body. The upper housing section 116 may include threads 122 for engaging the drill pipe 44 of the tubular string 42 and the intermediate housing section 118 respectively.

Although not limited to a particular attachment mechanism, in one or more embodiments, intermediate housing section 118 may include threads 124 for engaging the upper housing section 116 and the lower housing section 120. The intermediate housing section 118 further includes a set of one or more first shear pins 126 and a set of one or more second shear pins 128. As discussed in further detail below, the first shear pins 126 are engaged with the outer sleeve assembly 108 and the second shear pins 128 are engaged with the intermediate housing ring 110. The intermediate housing section 118 further contains one or more radial ports 130. Although two radial ports 130 are shown in FIG. 2A, it is anticipated that, in some embodiments, the intermediate housing section 118 may contain a plurality of radial ports 130 which may be in multiple planes along the length of the housing 100. The seal assembly 106 is positioned adjacent to the radial ports 130. In certain embodiments, the seal assembly 106 may have a first housing port seal 132 and a second housing port seal 134 positioned on opposing sides of the radial ports 130 sealing between the intermediate housing section 118 and the outer sleeve assembly 108. The seals may be disposed in seal seats formed in intermediate housing section 118 on opposing sides of ports 130. While not limited to a particular type of material for the construction of the seal, in one or more embodiments, seals 132, 134 may be formed of various types of elastomers including, but not limited to, unsaturated rubbers, saturated rubbers and thermoplastic elastomers.

Similar to the upper housing section 116, the lower housing section 120 contains threads 122 for engaging the drill pipe 44 of the tubular string 42 and the intermediate housing section 118 respectively. In some embodiments, the wellbore fluid communication tool 46 may include an upper housing seal 136 disposed between the upper housing section 116 and the intermediate housing section 118. Additionally, a lower housing 138 seal may be disposed between the lower housing section 120 and the intermediate housing section 118.

In a preferred embodiment, the outer sleeve assembly 108 may include a door assembly 140, a first sleeve collar 142 and a second sleeve collar 144. Further, the outer sleeve assembly 108 may include, as discussed further below, a plurality of releasable attachment mechanisms (described below), such as lugs disposed within the door assembly 140, the first sleeve collar 142 and the second sleeve collar 144. The door assembly 140 may include a first door 146 and a second door 148 positioned adjacent one another to define a door gap or joint 150 therebetween. As will be explained below, in certain configurations of wellbore fluid communication tool 46, doors 146, 148 are movable relative to one another so as to change the dimension of door gap 150 or in other words, to change the spacing between the doors 146, 148. When doors 146, 148 are substantially adjacent one another, or otherwise abut one another, door gap 150 may be characterized as "narrow" while moving doors 146, 148 apart from one another increases the spacing of door gap 150. In any event, in a first configuration of the wellbore fluid communication tool 46, the door gap 150 in a narrow configuration is positioned between the intermediate housing ring stop 112 and the first housing port seal 132. The first door 146 may include an upper section 152, a first releasable attachment mechanism 154, such as a first set of lugs and a lower section 156. Similarly, the second door 148 may include an upper section 158 a second releasable attachment mechanism 160, such as a second set of lugs 160 and a lower section 162. When the wellbore fluid communication tool 46 is in a first closed configuration, lugs 154 and lugs 160 are biased towards and engaged with the inner mandrel 114 by a spring or some other biasing mechanism as known in the art. Additionally, shear pins 126 are engaged with the upper section 152 of the first door 146 of the door assembly 140.

In an embodiment, the first sleeve collar 142 and the second sleeve collar 144 may be positioned spaced away axially from the door assembly 140 respectively. The first sleeve collar 142 may include a base 164 containing a third releasable attachment mechanism such as a third set of lugs 166, which are biased by a spring or some other biasing mechanism as known in the art, towards the inner mandrel 114. In one embodiment, the lugs may be biased by a garter spring nested into a groove formed on the outside diameter of lug 166. The first sleeve collar 142 may further include a crown 168 with a shoulder 170 defined therein. Additionally, an annulus 172 may be defined between the crown 168 of the first sleeve collar 142 and the inner mandrel 114. The second sleeve collar 144 may also include a base 174 that houses a fourth releasable attachment mechanism such as a fourth set of lugs 176, which are biased by a spring or some other biasing mechanism as known in the art, towards the inner mandrel 114. The second sleeve collar 144 may further include a crown 178 with a flange 180 that is affixed to the lower housing section 120. Similar to the first sleeve collar 142, an annulus 182 may be defined between the crown 178 of the second sleeve collar 144 and the inner mandrel 114. In an embodiment, the crown 178 and the base 174 of the second sleeve collar may be engaged together using threads 122, 124. However, in other embodiments the crown 178 and the base 174 may be formed as a continuous body.

With continued reference to FIG. 2A, the inner mandrel 114 contains an upper end 184, a lower end 186, a passageway 188 in fluid communication with the central passage 102, one or more radial orifices 190, an outer profile 192 containing one or more grooves 194 and a lower mandrel shoulder 196, which is substantially disposed within the outer sleeve assembly 108. Although one set of radial orifices 190 is shown in FIG. 2A, it is anticipated that, in some embodiments, the inner mandrel 114 may contain one or more orifices 190 arranged in one or more sets of radial orifices 190. In certain embodiments, the plurality of grooves 194 on the outer profile 192 includes a first mandrel groove 194*a*, a second mandrel groove 194*b*, a third mandrel groove 194*c* and a fourth mandrel groove 194*d*. In the wellbore fluid communication tool's 46 first closed configuration, lugs 154 are engaged with the first mandrel groove 194*a*, which is in radial alignment with the intermediate housing ring 110. Lugs 160 are engaged with the second mandrel groove 194*b*, which is positioned just below the second housing port seal 134. The third mandrel groove 194*c* is positioned between the lower section 162 of the second door 148 and the crown 168 of the first sleeve collar 142. Finally, the fourth mandrel groove 194*d* and the lower mandrel shoulder 196 are positioned in the annulus 182 of the second sleeve collar 144.

The wellbore fluid communication tool 46 may further include a first seat assembly 198 having an object seat 202, which is positioned near the upper end 184 of the inner mandrel 114. In one or more embodiments, seat assembly 198 may also include an upper lip 200 adjacent object seat 202. Moreover, object seat 202 may be extrudable. In an alternative embodiment, to be discussed further herein, the wellbore fluid communication tool 46 may include an additional seat assembly (not shown). In certain embodiments, the first seat assembly 198 may be engaged with the upper end 184 of the inner mandrel 114 by the use of threads 122,124.

Figure 2B:
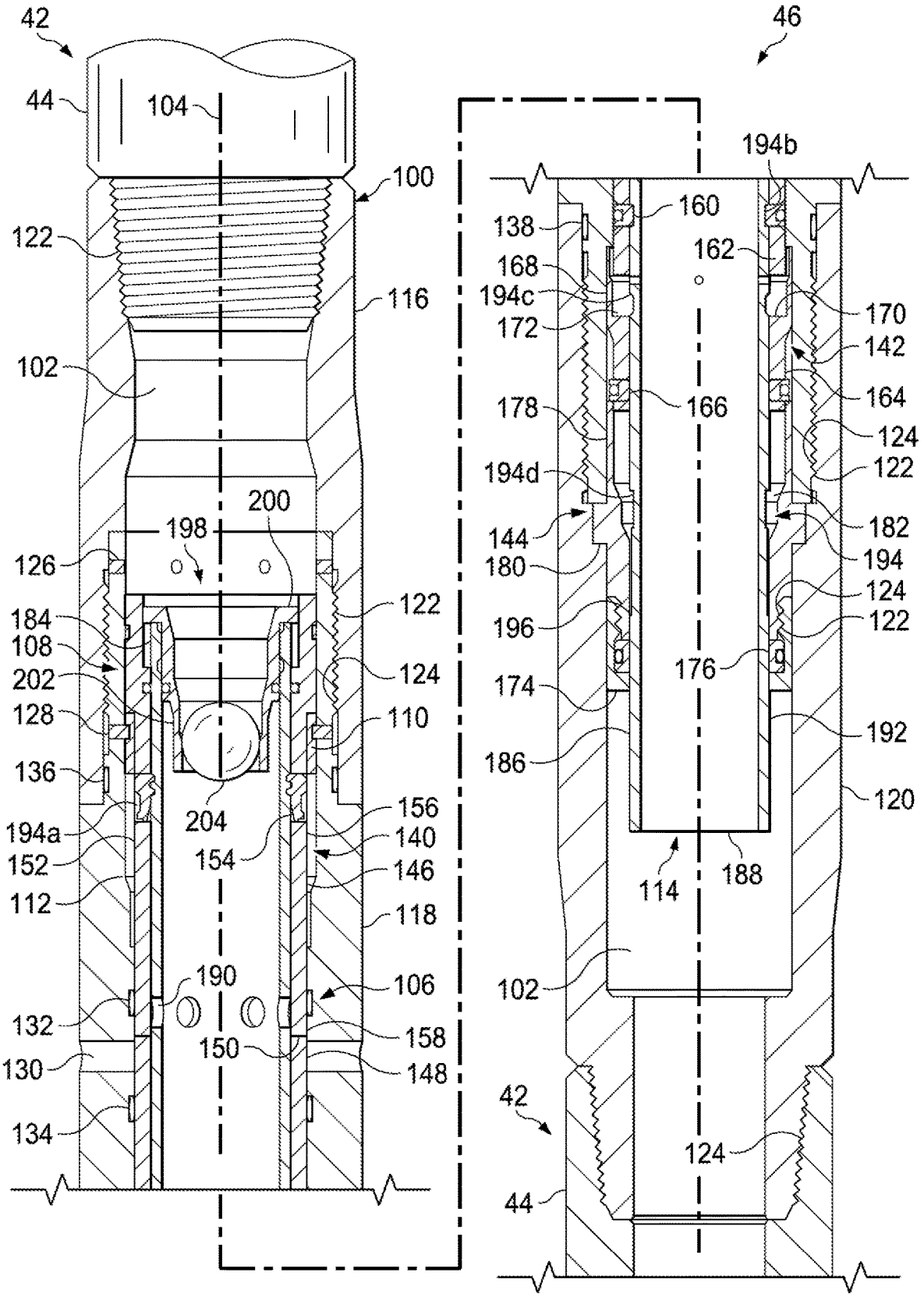
FIG. 2B depicts a cross-sectional view of a second configuration of the closed wellbore fluid communication tool used in a single trip wellbore cementing operation, according to one or more illustrative embodiments.

Turning now to FIG. 2B, a cross-sectional view of a second configuration of the closed wellbore fluid communication tool 46 is illustrated. In this second configuration, the closed door assembly 140 has been translated towards the first sleeve collar 142 with the narrow door gap 150 being translated across the first housing port seal 132. Translating the door assembly 140 across the seal assembly 106 in a closed position prevents damage from occurring to the seal assembly 106. As discussed above, the first housing port seal 132 and the second housing port seal 134 may be made of elastomeric materials, which are susceptible to degradation due to shear stresses. As the door assembly 140 in a closed position contains a narrow door gap 150, the area between the first and second door 146,148 is relatively small resulting in a fairly smooth translation across the first housing port seal 132 and the second housing port seal 134. In contrast, similar tools have designs that require open holes with larger areas to translate across an elastomeric seal, which has the potential to create a grating effect on the seal. This grating effect, may over time, debilitate the integrity of the seal and the operability of the tool.

In order to transition the wellbore fluid communication tool 46 from the first closed configuration to the second closed configuration, a first object 204 is landed on the seat 202 of the first seat assembly 198. As used herein, the first object 204 may be any device dropped or pumped down a wellbore for landing on seat 202, including without limitation, balls, darts or other objects. In any event, the tubular string 42 is pressurized and pressure is applied to the first object 204 through the central passage 102. A buildup of pressure uphole of the first object 204 results in axial translation of the door assembly 140, the first seat assembly 198 and the inner mandrel 114. Initially, the pressure build up on the upstream side of the first object 204 causes shearing of shear pins 126 from the upper section 152 of the first door 146, which allows upper section 152 of the first door 146 to axially translate down the intermediate housing section 118 until an exterior shoulder 206 of the upper section 152 of the first door 146 engages the intermediate housing ring 110. This movement allows the door gap 150, in its narrow configuration, to translate across the first housing port seal 132 and the lower section 162 of the second door 148 to enter the annulus 172 of the first sleeve collar 142. Once the upper section 152 of the first door 146 engages the intermediate housing ring 110, lugs 154 disengage the first mandrel groove 194*a* allowing the inner mandrel 114 to translate downward. This downward movement causes the radial orifices 190 to translate towards the radial ports 130 of the intermediate housing section 118, the second mandrel groove 194*b* to translate towards the crown 168 of the first sleeve collar 142, the third mandrel groove 194*c* to translate into the crown 168 of the first sleeve collar 142, the fourth mandrel groove 194*d* to translate further into the crown 178 of the second sleeve collar 144 and the lower mandrel shoulder 196 to translate into the base 174 of the second sleeve collar 144. Engagement of lugs 160 with second mandrel groove 194*b* prevents further translation of the inner mandrel 114 within the central passage 102.

Figure 2C:
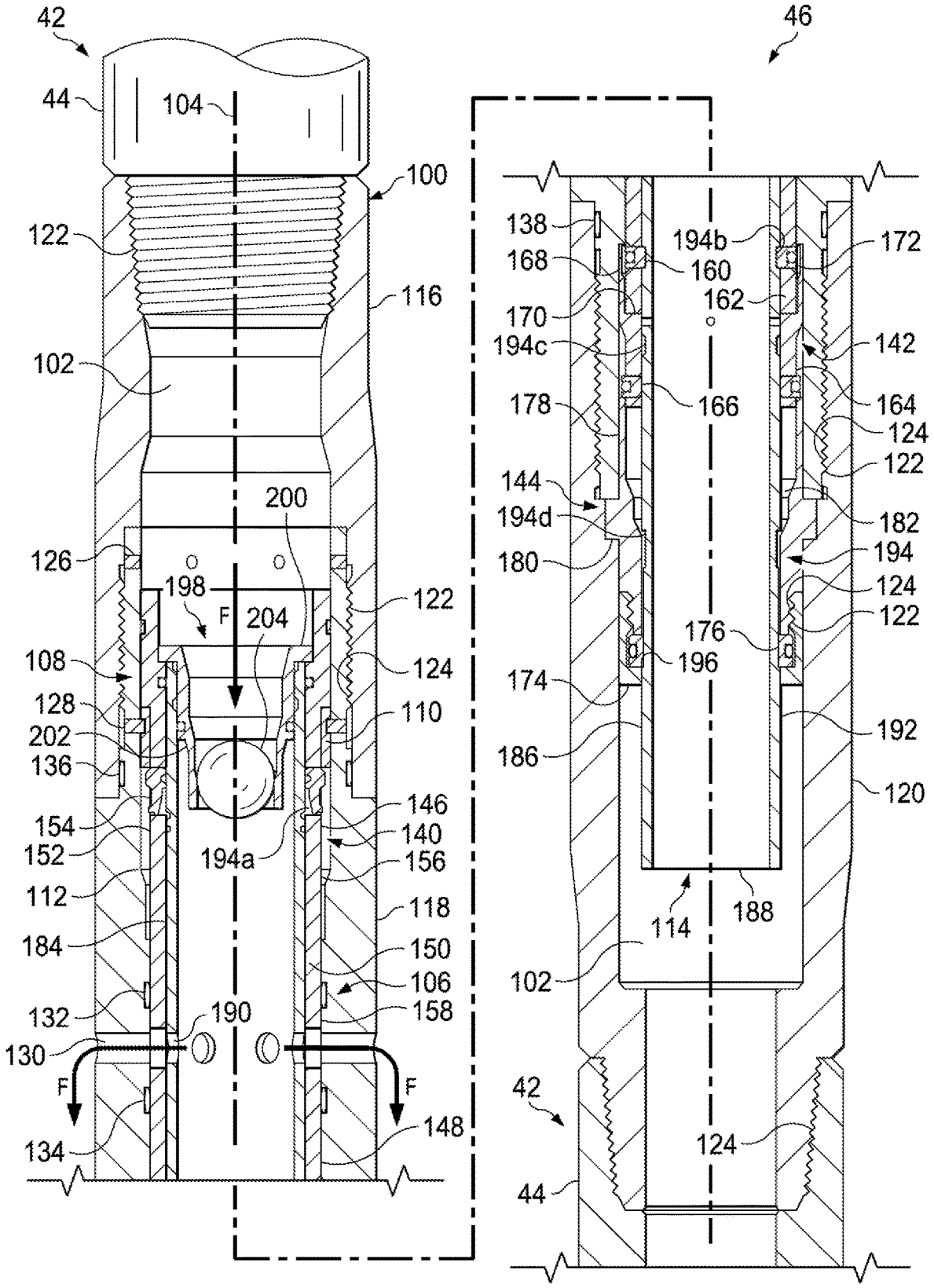
FIG. 2C depicts a cross-sectional view of the wellbore fluid communication tool in an open configuration, according to one or more illustrative embodiments.

In FIG. 2C, a depiction of the wellbore fluid communication tool 46 in an open configuration is illustrated. To open the wellbore fluid communication tool 46, additional pressure is applied through the tubular string 42 and the central passage 102 to first object 204. This pressure results in a downward force on the inner mandrel 114, causing the inner mandrel 114 to translate further into the central passage 102, which results in the radial alignment of the radial orifices 190 of the inner mandrel 114 and the radial ports 130 of the intermediate housing section 118. In embodiments with a lip 200, the upper lip 200 of the first seat assembly 198 engages inner mandrel 114. This downward movement of the inner mandrel 114 causes the second mandrel groove 194*b* to engage and apply a force on lugs 160, which in turn exert a downward force on the upper section 158 and the lower section 162 of the second door 148 translating the lower section 162 of the second door 148 into the annulus 172 of the first sleeve collar 142 until coming to rest on the shoulder 170 within the crown 168 of the first sleeve collar 142. Once the lower section 162 of the second door 148 engages the shoulder 170 of the first sleeve collar 142 the door gap 150 spacing is at full extension, effectively opening the door assembly 140 of the wellbore fluid communication tool 46 and providing a fluid communication path "F" through the tubular string 42, the central passage 102, the radial orifices 190, and the radial ports 130 in the intermediate housing section 118 to the annulus 62 of the wellbore 20. Further, when the second door 148 has engaged the shoulder 170 of the first sleeve collar 142, the fourth mandrel groove 194*d* has translated further into the crown 178 of the second sleeve collar 144 and the lower mandrel shoulder 196 has translated past lugs 176 allowing lugs 176 to collapse on a primary outer diameter "OD" of the outer profile 192 of the inner mandrel 114. This primary outer diameter "OD" is defined on the outer profile 192 between the upper end 184 and the lower mandrel shoulder 196 of the inner mandrel 114. This configuration prevents undesired upward movement of the inner mandrel 114, which would close the door assembly 140 and block the fluid communication path "F", as the engagement of lugs 176 and the lower mandrel shoulder 196 precludes upward translation of the inner mandrel 114.

As previously discussed, when the wellbore fluid communication tool 46 is in an open configuration, the second phase of the single trip cementing job may be implemented. Once the door assembly 140 of the wellbore fluid communication tool 46 is opened, the pressure in the tubular string 42 may be increased to extrude the first object 204 from the first seat assembly 198. Cement is subsequently injected from the cementing head 16 through the tubular string 42 and into the wellbore fluid communication tool 46. As discussed with reference to FIG. 1, the sealed float assembly 54 and the spotting fluid 66 previously pumped into the liner 52 serve as a barrier forcing the cement to travel through the radial ports 130 of the intermediate housing section 118 and down into the annulus 62 of the wellbore 20.

Figure 2D:
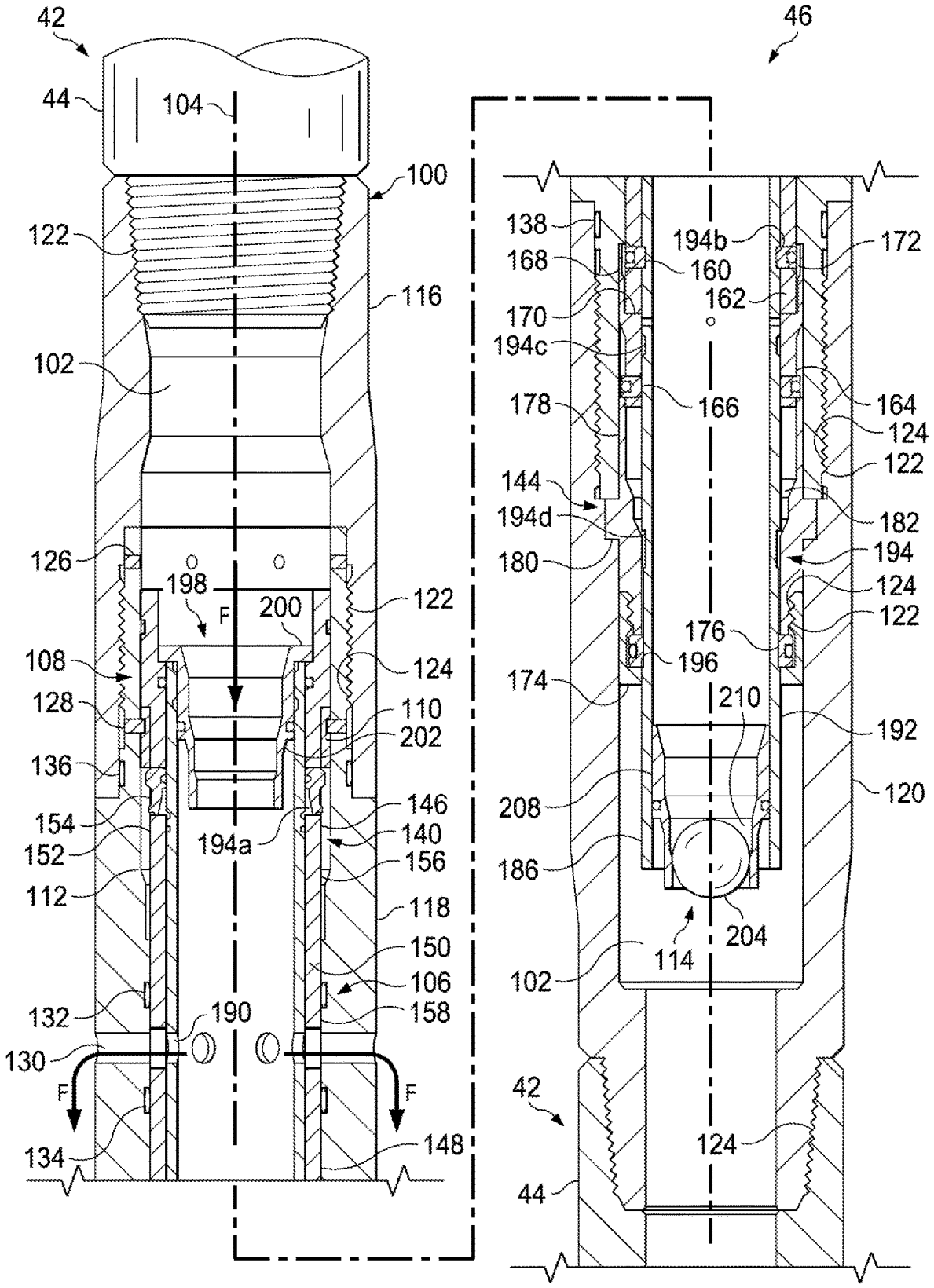
FIG. 2D depicts a cross-sectional view of an alternative embodiment of the wellbore fluid communication tool, in an open configuration, according to one or more illustrative embodiments.

In an alternative embodiment, as depicted in FIG. 2D, the wellbore fluid communication tool 46 includes a second seat assembly 208 having a seat 210, which is disposed at the lower end 186 of the inner mandrel 114. With the exception of the second seat assembly 208, this alternative embodiment of the wellbore fluid communication tool 46 contains the same features as previously described with respect to FIGS. 2A-2C. In operation, once the door assembly 140 of the wellbore communication tool 46 has been opened, the first object 204 from the first seat assembly 198 is extruded and landed in the second seat assembly 208. In lieu of the spotting fluid 66 preventing the cement from traveling into the liner 52, the second seat assembly 208 along with the first object 204 landed therein are used as barrier forcing the cement to travel through the plurality of radial ports 130 of the intermediate housing section 118 and down into the annulus 62 of the wellbore 20. Once the secondary cementing operation has been completed, in certain embodiments the pressure through the tubular string 42 and in the central passage 102 is increased to extrude the first object 204 from the second seat assembly 208.

Figure 2E:
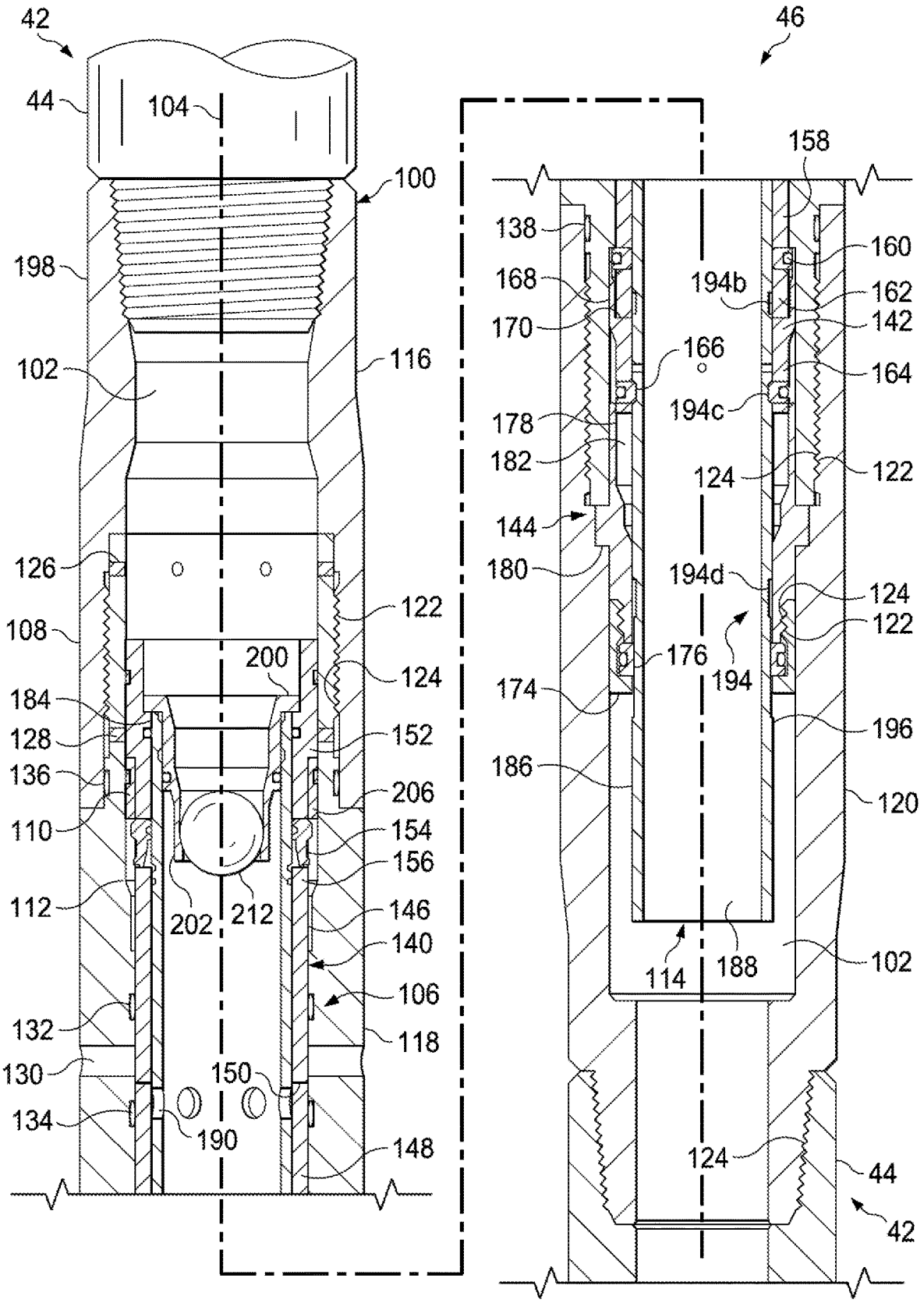
FIG. 2E depicts a cross-sectional view of the wellbore fluid communication tool once it has been closed after the completion of the single trip wellbore cementing operation, according to one or more illustrative embodiments.

FIG. 2E depicts a cross-sectional view of a wellbore fluid communication tool 46, which has been closed after completion of the single trip wellbore cementing operation, according to one or more illustrative embodiments. To close the wellbore fluid communication tool 46, a second object 212, which in certain embodiments may be larger than the first object 204, is landed in the object seat 202 of the first seat assembly 198. The tubular string 42 is again pressurized and pressure is applied to the second object 212 through the central passage 102. The uphole pressure against the second object 212 results in shearing of the second shear pins 128 from the intermediate housing ring 110, which causes the downward movement of the intermediate housing ring 110. This movement enables the lower section 156 of the first door 146 to translate across the plurality of radial ports 130 of the intermediate housing section 118 until mating with the upper section 158 of the second door 148, thereby forming the narrow door gap 150 of the door assembly 140 between the plurality of radial ports 130 and the second housing port seal 134 and effectively closing the door assembly 140.

Shearing of the second shear pins 128 from the intermediate housing ring 110 also results in further downward translation of the first seat assembly 198 and the inner mandrel 114 within the central passage 102. The pressure build up against the second object 212 causes first seat assembly 198 to exert a downward force on the inner mandrel 114, such as via the upper lip 200. This force causes the second mandrel groove 194*b* to disengage lugs 160 in the second door 148, forcing the lugs 160 in a radial direction towards the crown 168 of the first sleeve collar 142 and facilitating further downward translation of the second mandrel groove 194*b*, the third mandrel groove 194*c*, the fourth mandrel groove 194*d* and the lower mandrel shoulder 196. This further downward translation results in the collapsing and seating of lugs 166 in the third mandrel groove 194*c*. Additionally, this translation causes the fourth mandrel groove 194*d* to move further within the crown 178 of the second sleeve collar 144 and the lower mandrel shoulder 196 to be positioned outside of the second sleeve collar 144.

Figure 2F:
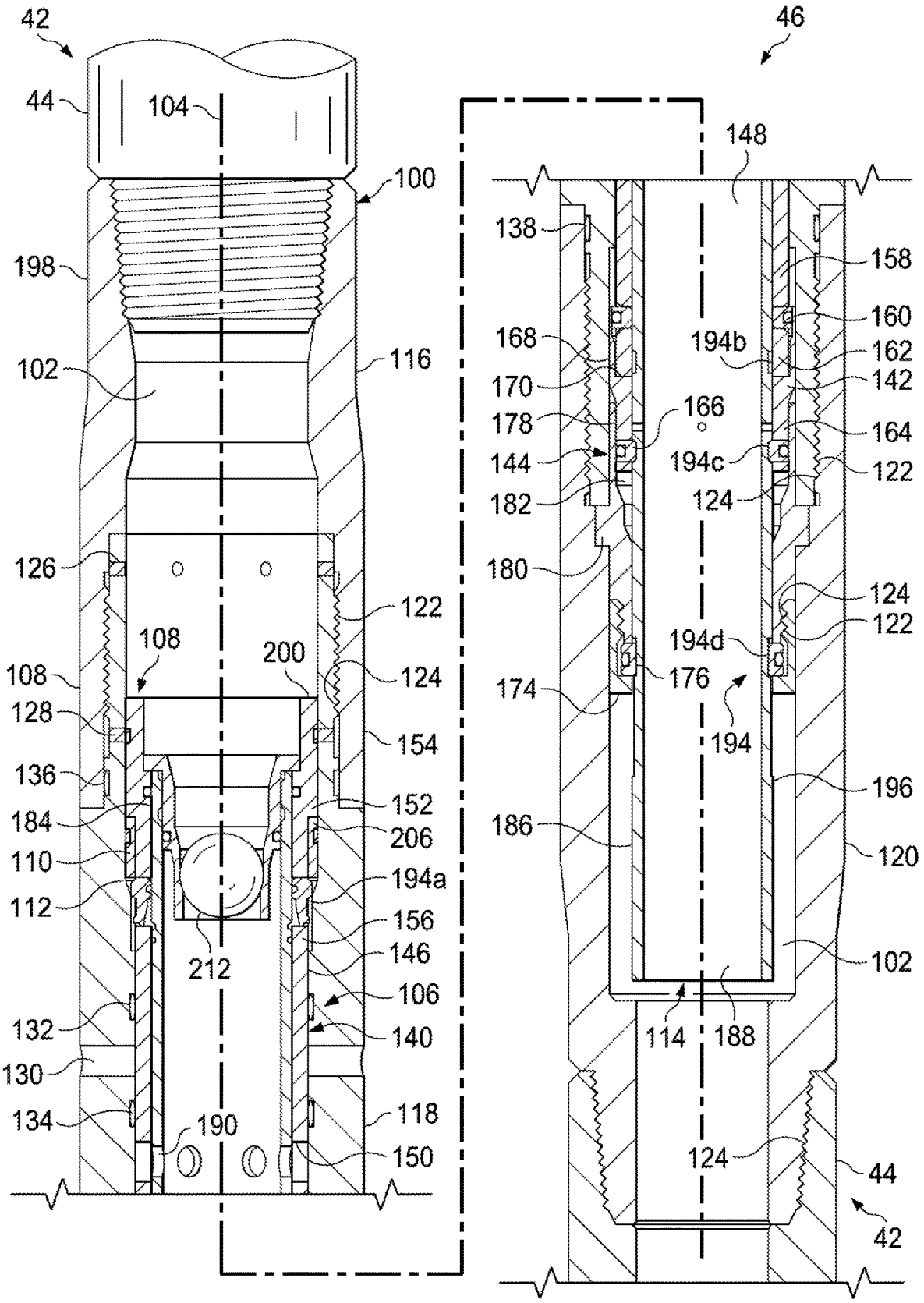
FIG. 2F depicts a cross-sectional view of the wellbore fluid communication tool once it has been sealed after the completion of the single trip wellbore cementing operation, according to one or more illustrative embodiments.

FIG. 2F depicts a cross-sectional view of the wellbore fluid communication tool 46 once it has been sealed after the completion of the single trip wellbore cementing operation. To seal the door assembly 140 of the wellbore fluid communication tool 46, additional pressure is applied to the second object 212 previously landed in the object seat 202 of the first seat assembly 198. This pressure causes the first seat assembly 198 to exert a downward force on the first door 146 and the inner mandrel 114, such as via the upper lip 200. This downward force causes the upper section 152 of the first door 146 to push the intermediate housing ring 110 downward until it engages the intermediate housing ring stop 112 further resulting in the translation of the narrow door gap 150 across the second housing port seal 134 and the translation of the base 164 of the first sleeve collar 142 into the crown 178 of the second sleeve collar 144. The translation of the base 164 of the first sleeve collar 142 into the crown 178 of the second sleeve collar 144 is further facilitated by the seating of lugs 166 in the third mandrel groove 194*c* as described with respect to FIG. 2E. Additionally, the downward force as described above results in the inner mandrel 114 translating further within the central passage 102 facilitating the seating of lugs 176 within the fourth mandrel groove 194*d*.

Once the wellbore fluid communication tool 46 has been sealed, in certain embodiments, further pressure may be applied to the second object 212 to extrude it from the first seat assembly 198. The second object 212 may be extruded and used to actuate any number of tools on the tubular string 42 downstream. For instance, the second object 212 may be landed in the liner hanger running tool 48 for use in setting the expandable liner hanger 50 as described with respect to FIG. 1.

Figure 3:
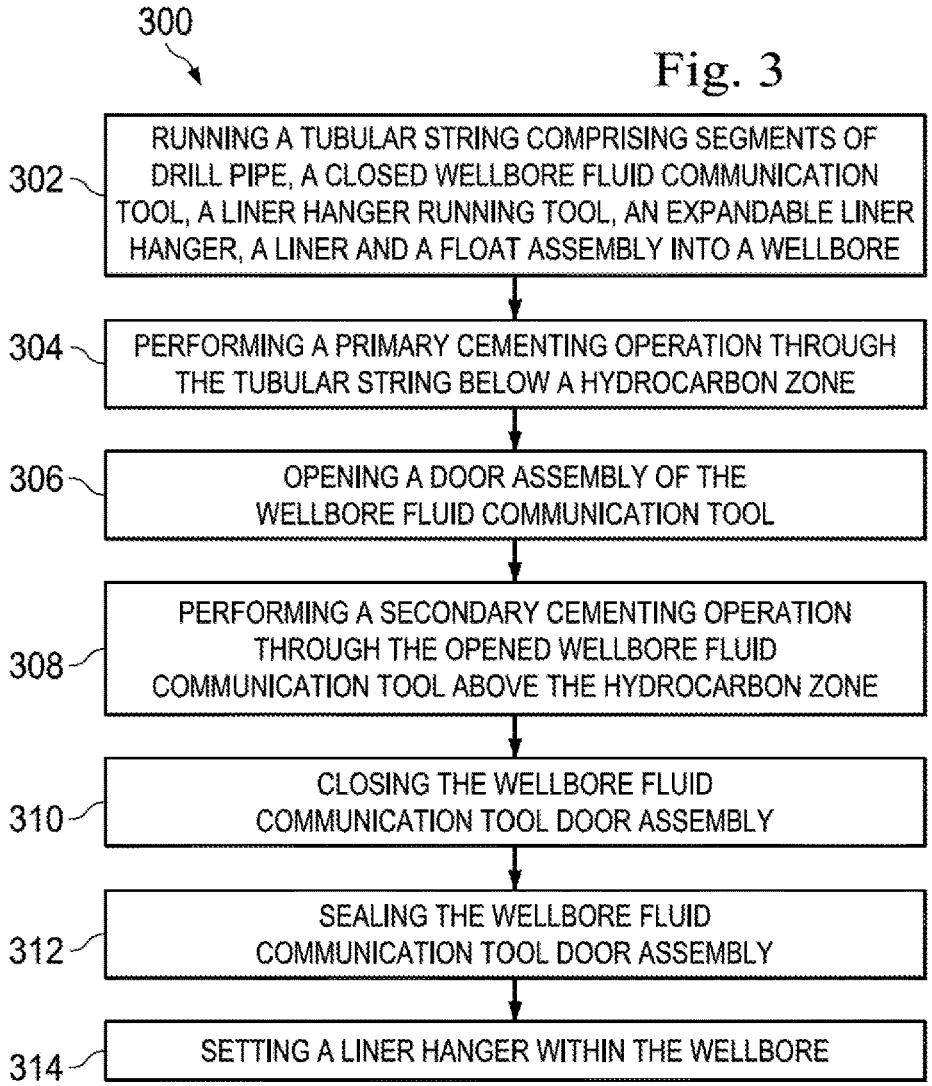
FIG. 3 is a flowchart illustrating an exemplary method for performing a single trip wellbore cementing operation performed in a wellbore using the wellbore fluid communication tool during construction of the wellbore.

With reference to FIG. 3, a flow chart of an exemplary method 300 for performing a single trip cementing operation in the wellbore 20 is described. Although the cementing operation need not be limited to particular locations in the wellbore 20, in one or more embodiments, the operations may be performed above and below a hydrocarbon zone 22 during the construction of the wellbore 20 using the wellbore fluid communication tool 46.

Method 300 begins in step 302, by running a tubular string 42 comprising segments of drill pipe 44, a closed wellbore fluid communication tool 46, and a float assembly 54 into the wellbore 20, which has been drilled through a hydrocarbon zone 22. The tubular string may also include a liner hanger running tool 48, an expandable liner hanger 50, and a liner 52. In preferred embodiments of the method, the wellbore fluid communication tool 46 is positioned at a first location in the wellbore 20. The first location is spaced apart from a second location that is downstream or downhole of the first location. In preferred embodiments, when fluid communication tool 46 is in the first location, float assembly 54 is in the second location, which may be adjacent, the bottom 40 of the wellbore 20. The first location may be above the hydrocarbon zone 22 and the float assembly 54 is positioned at the second location, namely a position below the hydrocarbon zone 22. In other embodiments, the wellbore fluid communication tool 46 can be positioned anywhere along a wellbore 20 as desired. More generally, the wellbore fluid communication tool 46 as described herein need not be utilized in only cementing operations, but may be used in any operations where it is desirable to establish fluid communication between the interior of the tubular string 42 and an annulus 62 about the tubular string 42.

After the tubing string 42 has been positioned within the wellbore 20 at the first location, in step 304, a primary cementing operation is performed at the second location by passing cementing fluids through the tubular string 42 to a location below the hydrocarbon zone 22. The primary cementing operation begins by using a cement pump 28 to discharge cement into a cementing head 16 located at the surface 14. The cementing head 16 injects the cement through the tubular string 42 where it discharges onto the wellbore bottom 40 through a guide shoe 60 of the float assembly 54. Injection of cement within the tubular string 42 is terminated when the desired area of the wellbore 20 below the hydrocarbon zone 22 is filled with cement. Thereafter, in some embodiments, a wiper plug may be deployed through the tubular string 42 to remove any remaining cement until coming to rest in a float collar 56 of the float assembly 54, effectively sealing the bottom of the liner 52. In some embodiments, a volume of a spotting fluid 66 is injected through the tubular string 42 to fill the liner 52.

In step 306, a door assembly 140 of the wellbore fluid communication tool 46 is opened to the annulus 62 of the wellbore 20. In a preferred embodiment, the wellbore fluid communication tool 46 includes a housing 100 containing a central passage 102 therethrough, the housing 100 includes one or more radial ports 130, which facilitate fluid communication between the central passage 102 and a location external to the housing 100 such as the annulus 62 of the wellbore 20. Disposed along the central passage 102, the wellbore fluid communication tool 46 further includes a seal assembly 106; an outer sleeve assembly 108 having a door assembly 140 which may be operable to translate across the seal assembly 106 in a closed position and a plurality of lugs (154, 160, 166 and 176); an inner mandrel 114 having one or more radial orifices 190 and a plurality of grooves 194*a*-194*d*; and a first seat assembly 198 disposed within the outer sleeve assembly 108 and coupled to the inner mandrel 114.

To initiate opening the door assembly 140 of the wellbore fluid communication tool 46, the wellbore fluid communication tool 46 must be transitioned from a first closed configuration to a second closed configuration. In the wellbore fluid communication tool's 46 first closed configuration, doors 146, 148 are abutting or substantially close to one another such that door gap 150 is in its narrow configuration and movement of the doors assembly 140 relative to housing 100 is prevented by a first releasable locking mechanism, such as a shear pin 126. To begin the transition, a first object 204 is landed in the first seat assembly 198 and a first pressure is applied against the first object 204 through tubular string 42 and the central passage 102. In certain embodiments the first object 204 may be dropped or pumped from the surface; however, it is envisioned that the first object 204 may also be deployed from a downhole location using an object dropping assembly tool (not shown) disposed along the tubular string 42.

Nonetheless, the pressure applied against the first object 204 causes the first releasable locking mechanism, i.e., the first shear pins 126 to shear. The continued downward force exerted on the closed door assembly 140 causes the closed door assembly 140, and specifically, first and second doors 146, 148 in their abutting position, to collectively translate in a downward axial direction until the outer sleeve 108 engages the intermediate housing ring 110. Notably, first shear pin 126 is selected to shear upon application of a first force applied by the first pressure. In any event, the axial movement of door assembly 140 results in door gap 150—in its narrow configuration, i.e., when the doors 146, 148 are abutting or substantially close to one another—to translate across a first housing port seal 132 of the seal assembly 106. In other words, doors 146, 148 collectively translate or move together and the door gap 150 passes across the first housing port seal 132. Because doors 146, 148 collectively translate together in a closed position, damage to the first housing port seal 132 by door gap 150 is minimized. Once this occurs, lugs 154 in the closed door assembly 140 become disengaged from the first mandrel groove 194*a* of the inner mandrel 114, facilitating the further downward translation of inner mandrel 114 and the first seat assembly 198 into the central passage 102.

To open the door assembly 140 of the wellbore fluid communication tool 46, a second pressure, which may be higher, lower or equal to that of the first pressure, is applied against the first object 204, causing the first seat assembly 198 to exert a downward force on the inner mandrel 114. Under this force, the inner mandrel 114 is translated further along the central passage 102 to a position where the orifices 190 of the inner mandrel 114 are aligned with the radial ports 130 of the housing 100. This downward movement of the inner mandrel 114 also causes the second mandrel groove 194*b* to engage and apply a force on the lugs 160 of the door assembly 140, which in turn exerts an axial downward force on the second door 148, causing second door 148 to shift downward, individually translating away from first door 146. Specifically, second door 148 is translated the into the annulus 172 of the first sleeve collar 142, thereby expanding door gap 150, effectively opening the door assembly 140 of the wellbore fluid communication tool 46 and providing a fluid communication path "F" between through the tubular string 42, the central passage 102, the radial orifices 190 in the inner mandrel 114 and the radial ports 130 in the housing 100 to the annulus 62 of the wellbore 20. In one or more embodiments, under application of the second pressure, translation of inner mandrel 114 and second door 148 in this step occur simultaneously, such that port 130 and orifice 190 are aligned while at the same time second door 148 individually translates or moves away from first door 146. As discussed above, the second pressure may be greater than, the same as or less than the first pressure, it being understood that once pin 126 has sheared, inner mandrel 114 may translate under application of a smaller pressure than was necessary to shear pin 126.

Once the wellbore fluid communication tool 46 is in an open configuration, in step 308, a secondary cementing operation may be performed through the opened wellbore fluid communication tool 46 above the hydrocarbon zone 22 or the location of the primary cementing operation by directing cementing fluids through the aligned orifice 190 and port 130 in order to deliver cementing fluids to the annulus about the wellbore fluid communication tool 46. In one or more embodiments, to begin the secondary cementing operation, the pressure in the tubular string 42 is increased to drive or otherwise extrude the landed first object 204 from the first seat assembly 198. Cement is subsequently injected from the cementing head 16 through the tubular string 42 and into the wellbore fluid communication tool 46. As discussed with reference to step 302, the sealed float assembly 54 and the spotting fluid 66 previously pumped through the tubular string 42 and into the liner 52 serve as a barrier forcing the cement to travel through the radial ports 130 of the housing 100 and down into the annulus 62 of the wellbore 20.

In an alternative embodiment, the wellbore fluid communication tool 46 includes a second seat assembly 208, which is disposed at the lower end 186 of the inner mandrel 114. With the exception of the second seat assembly 208, this alternative embodiment of the wellbore fluid communication tool 46 contains the same features as previously described with respect to steps 302-306. In operation, once the door assembly 140 of the wellbore communication tool 46 has been opened, the first object 204 from the first seat assembly 198 is extruded and landed into the second seat assembly 208. In lieu of the spotting fluid 66 preventing the cement from traveling into the liner 52, the second seat assembly 208 along with the first object 204 landed therein are used to force the cement to travel through the radial ports 130 of the intermediate housing section 118 and down into the annulus 62 of the wellbore 20.

In step 310, the wellbore fluid communication tool 46 is closed to the annulus 62 of the wellbore 20. To close the wellbore fluid communication tool 46, a second object 212, which in certain embodiments is larger than the first object 204, is landed in the first seat assembly 198. The tubular string 42 is again pressurized and pressure is applied to the second object 212 through the central passage 102. The uphole pressure against the second object 212 results in shearing of the second shear pins 128 from the intermediate housing ring 110, which causes the downward movement of the intermediate housing ring 110 enabling the first door 146 to translate across the plurality of radial ports 130 of the housing 100 until mating with the second door 148, thereby driving door gap 150 to a "narrow" configuration and positioning door gap 150 of the door assembly 140 between radial ports 130 and the second housing port seal 134 and effectively closing the door assembly 140 of the wellbore fluid communication tool 46.

In step 312, the wellbore fluid communication tool 46 is sealed. To seal the door assembly 140 of the wellbore fluid communication tool 46, additional pressure is applied to the second object 212 previously landed in the first seat assembly 198. This pressure causes the first seat assembly 198 to exert a downward force on the first door 146 and the inner mandrel 114. In certain embodiments, the downward force is translated via an upper lip 200 of the seat assembly 198. This downward force causes the first door 146 to push the intermediate housing ring 110 downward until it engages the intermediate housing ring stop 112 further resulting in the translation of the narrow door gap 150 across the second housing port seal 134 and the translation of the first sleeve collar 142 into second sleeve collar 144 effectively sealing the door assembly of the wellbore fluid communication tool 46.

Finally in step 314, once the wellbore fluid communication tool is sealed, in certain embodiments, the expandable liner hanger 50 may be set within the wellbore 20. To set the expandable liner hanger 50, further pressure may be applied through the tubular string 42 and the central passage 102 to the second object 212 to extrude or otherwise drive it from the first seat assembly 198. The second object 212 may then be landed in the liner hanger running tool 48 for use in setting the expandable liner hanger 50 within the wellbore 20.

Figure 4:
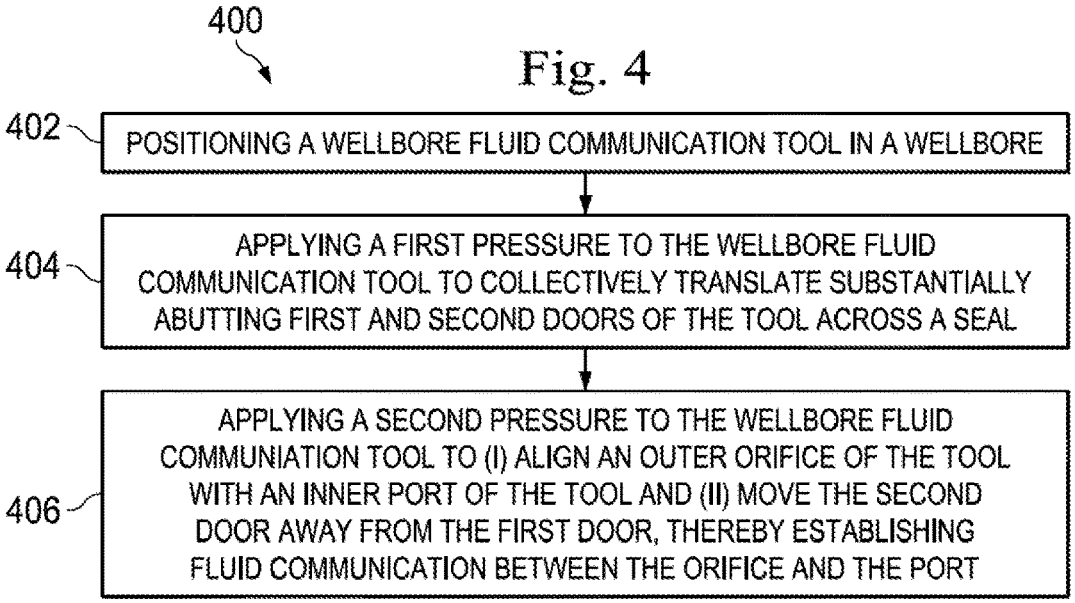
FIG. 4 is a flowchart illustrating an exemplary method for establishing fluid communication between a tubular string and a wellbore, according to one or more illustrative embodiments.

With reference to FIG. 4, a flowchart illustrating an exemplary method 400 for establishing fluid communication between a tubular string 42 and a wellbore 20 is described.

Method 400 begins in step 402, by positioning a wellbore fluid communication tool 46 in a wellbore 20. In certain embodiments, this may be accomplished by running a tubular string 42 comprising segments of drill pipe 44, and a wellbore fluid communication tool 46 in a first closed configuration into the wellbore 20. In the wellbore fluid communication tool's 46 first closed configuration, doors 146, 148 are abutting or substantially close to one another such that door gap 150 is in its narrow configuration and movement of the doors assembly 140 relative to housing 100 is prevented by a first releasable locking mechanism, such as a shear pin 126. Depending on the scope of the subsurface operation, the closed wellbore fluid communication tool 46 may be placed at any location along the tubular string 42 in which fluid communication with the wellbore 20 is desired.

In step 404, a first pressure is applied to the wellbore fluid communication tool 46 to collectively translate substantially abutting first and second doors 146, 148 of the tool across a first housing port seal 132. Once the wellbore fluid communication tool 46 is positioned at a desired location within the wellbore 20, a first object 204 is landed in the first seat assembly 198 and pressure is applied against the first object 204 through tubular string 42 and the central passage 102. In certain embodiments the first object 204 may be dropped or pumped from the surface; however, it is envisioned that the first object 204 may also be deployed from a downhole location using an object dropping assembly tool (not shown) disposed along the tubular string 42.

Nonetheless, the pressure applied against the first object 204 causes the first releasable locking mechanism, i.e., shear pins 126 to shear. The continued downward force exerted on the closed door assembly 140 causes the closed door assembly 140, and specifically, first and second doors 146, 148 in their abutting position, to collectively translate in a downward axial direction until the outer sleeve 108 engages the intermediate housing ring 110. Notably, first shear pin 126 is selected to shear upon application of a first force applied by the first pressure. In any event, the axial movement of door assembly 140 results in door gap 150—in its narrow configuration, i.e., when the doors 146, 148 are abutting or substantially close to one another—to translate across the first housing port seal 132 of the seal assembly 106. In other words, doors 146, 148 collectively translate or move together and the door gap 150 passes across seal 132. Because doors 146, 148 collectively translate together in a closed position, damage to first housing port seal 132 by door gap 150 is minimized. Once this occurs, lugs 154 in the closed door assembly 140 become disengaged from the first mandrel groove 194*a* of the inner mandrel 114, facilitating the further downward translation of inner mandrel 114 and the first seat assembly 198 into the central passage 102.

In step 406, the wellbore fluid communication tool 46 is opened to the annulus 62 of the wellbore 20 by applying a second pressure to the wellbore fluid communication tool 46 to align at least one radial port 130 with at least one inner orifice 190 of the wellbore fluid communication tool 46 and to move the second door 148 away from the first door 146, thereby establishing fluid communication between the radial port 130, inner orifice 190 and the annulus 62 of the wellbore 20.

To begin this process, as previously described, the second pressure, which may be higher, lower or equal to that of the first pressure, is applied against the first object 204, causing the first seat assembly 198 to exert a downward force on the inner mandrel 114. Under this force, the inner mandrel 114 is translated further along the central passage 102 to a position where the orifices 190 of the inner mandrel 114 are aligned with the radial ports 130 of the housing 100. This downward movement of the inner mandrel 114 also causes the second mandrel groove 194*b* to engage and apply a force on the lugs 160 of the door assembly 140, which in turn exerts an axial downward force on the second door 148, causing second door 148 to shift downward, individually translating away from first door 146. Specifically, second door 148 is translated the into the annulus 172 of the first sleeve collar 142, thereby expanding door gap 150, effectively opening the door assembly 140 of the wellbore fluid communication tool 46 and providing a fluid communication path "F" between through the tubular string 42, the central passage 102, the radial orifices 190 in the inner mandrel 114 and the radial ports 130 in the housing 100 to the annulus 62 of the wellbore 20. In one or more embodiments, under application of the second pressure, translation of inner mandrel 114 and second door 148 in this step occur simultaneously, such that port 130 and orifice 190 are aligned while at the same time second door 148 individually translates or moves away from first door 146. As previously discussed, the second pressure may be greater than, the same as or less than the first pressure, it being understood that once pin 126 has sheared, inner mandrel 114 may translate under application of a smaller pressure than was necessary to shear pin 126.

Thus a wellbore fluid communication tool has been described. Embodiments of the tool may include a housing having a central passage therethrough along a longitudinal axis, the housing including at least one radial port; a seal assembly disposed along the central passage and adjacent to the radial port; an outer sleeve assembly disposed within the housing along the central passage, the sleeve assembly having first and second doors abutting one another to define a door gap, the door gap initially positioned upstream of the seal assembly; an inner mandrel having a radial orifice, the inner mandrel being operable to selectively engage the outer sleeve assembly by a plurality of grooves and a lower mandrel shoulder disposed on an outer profile of the inner mandrel; and a first seat assembly disposed within the outer sleeve assembly and coupled to the inner mandrel; wherein first and second doors are operable to selectively facilitate fluid communication between the central passage and a location external to the housing.

For the foregoing embodiment, the wellbore fluid communication tool may further include any one of the following elements, alone or in combination with each other:

An intermediate housing ring releasably secured to the housing and spaced apart from a shoulder defined on the outer sleeve.

A first releasable locking mechanism disposed to lock the housing and outer sleeve to one another and a second releasable locking mechanism disposed to lock the intermediate housing ring to the housing.

The seal assembly further comprising a first housing port seal and a second housing port seal, which are disposed on opposing sides of the radial port.

The outer sleeve assembly further comprising a first sleeve collar and a second sleeve collar, which are positioned below the first door and the second door.

The second sleeve collar affixed to the housing.

The first sleeve collar slidably disposed about the inner mandrel below the second door and above the second sleeve collar.

The outer sleeve assembly further comprising a plurality of lugs that are operable to selectively engage the plurality of grooves and the lower mandrel shoulder of the inner mandrel.

A second seat assembly disposed within the inner mandrel near the lower mandrel shoulder.

Additionally an alternate embodiment of a wellbore fluid communication tool has been described herein. Such an embodiment may include a housing having a central passage therethrough extending between a first end and a second end and defined along a longitudinal axis, the housing including at least one radial port; a seal assembly disposed along the housing along the central passage between the radial port and the first end of the housing; an outer sleeve assembly disposed within the housing along the central passage, the sleeve assembly having first and second doors abutting one another to define a door gap, the door gap positioned between the seal assembly and the first end of the housing when the first and second doors are in a first closed position; an inner mandrel having a radial orifice, the inner mandrel disposed within the outer sleeve assembly so that the radial orifice is adjacent the door gap, the inner mandrel having a plurality of grooves defined therealong; a first releasable locking mechanism securing the outer sleeve assembly to the housing in the first locked position; a first releasable attachment mechanism extending from the outer sleeve assembly to engage a groove of the inner mandrel to securing the inner mandrel to the outer sleeve assembly in the first position; and a first seat assembly disposed within the outer sleeve assembly and coupled to the inner mandrel, the outer sleeve assembly and the inner mandrel slidable within the housing to a second position when the first releasable locking mechanism is released.

For the foregoing embodiment, the wellbore fluid communication tool may further include any one of the following elements, alone or in combination with each other:

The outer sleeve assembly includes a shoulder and the wellbore fluid communication tool further comprises an intermediate housing ring secured to the housing by a second releasable locking mechanism, the housing ring spaced apart from the outer sleeve shoulder when the tool is in the first position.

The first releasable locking mechanism is a shear pin.

A seal assembly disposed along the housing on opposing sides of the radial port.

The outer sleeve assembly further includes a first sleeve collar and a second sleeve collar which are positioned below the first door and the second door.

Thus a method for conducting cementing operations in a wellbore has been described herein, wherein the method includes positioning a cementing tool in a wellbore at a first location spaced apart from a second location that is downstream of the first location; conducting cementing operations at the second location; following the cementing operations at the second location, applying a first pressure to the cementing tool to collectively translate substantially abutting first and second doors together across a seal of the cementing tool; applying a second pressure to the cementing tool to (i) align an orifice of the cementing tool with a port of the cementing tool and (ii) individually translate the second door away from the first door, thereby establishing fluid communication between the orifice and the port; and conducting cementing operations at the second location For the foregoing embodiment, the method may include any of the following steps alone or in combination with each other:

Conducting cementing operations at the second location comprises directing cementing fluids through the aligned orifice and port in order to deliver cementing fluids to an annulus about the cementing tool.

Applying the first pressure by landing an object on a seat within the cementing tool and applying pressure to the object until a shear mechanism ruptures, allowing the first and second doors to collectively translate.

Conducting cementing operations at the second location comprises driving the landed object from a seat and passing cementing fluids through the seat to the aligned orifice and port.

Thus a method for establish fluid communication in a wellbore has been described herein, wherein the method includes: positioning a wellbore fluid communication tool in a wellbore; applying a first pressure to the tool to collectively translate substantially abutting first and second doors of the tool across a seal; and applying a second pressure to wellbore fluid communication tool to (i) align an outer orifice of the tool with an inner port of the tool and (ii) move the second door away from the first door, thereby establishing fluid communication between the orifice and the port.

For the foregoing embodiment, the method may include the following step:

Applying the first pressure by landing an object in a seat of the tool and applying the first pressure to the object until a shear pin release the first and second doors from a first closed position, allowing the doors to collectively translate to a second closed position.

The above specific example embodiments are not intended to limit the scope of the claims. The example embodiments may be modified by including, excluding, or combining one or more features or functions described in the disclosure.

What is claimed is:

1. A wellbore fluid communication tool, the tool comprising:

a housing having a central passage therethrough along a longitudinal axis, the housing including at least one radial port;

a seal assembly disposed along the central passage and adjacent to the radial port, the seal assembly including a first housing port seal disposed on an upstream side of the radial port;

an outer sleeve assembly disposed radially within the housing along the central passage, the sleeve assembly having first and second doors abutting one another to define a door gap in a closed configuration, the door gap initially positioned upstream of the first housing port of the seal assembly;

an inner mandrel disposed radially within the outer sleeve assembly and having a radial orifice initially positioned upstream of the first housing port; and a first seat assembly disposed within the outer sleeve assembly and initially coupled to the inner mandrel and the first and second doors of the outer sleeve assembly to move axially downstream together in response to a first object landing in the first seat assembly;

wherein the first door is operable to be disengaged from the first seat assembly, the second door and the inner mandrel in response to the door gap moving axially past the first housing port seal in the closed configuration such that the second door separates from the first door to define an open configuration of the door gap to selectively facilitate fluid communication between the central passage and a location external to the housing.

2. The wellbore fluid communication tool of claim 1, further comprising an intermediate housing ring releasably secured to the housing and spaced apart from a shoulder defined on the outer sleeve, wherein the intermediate housing ring is positioned to support the first door upstream of the second door in the housing when the shoulder engages the intermediate housing ring and the door gap is in the open configuration.

3. The wellbore fluid communication tool of claim 2, wherein the housing further comprises a first releasable locking mechanism disposed to lock the housing and outer sleeve to one another and a second releasable locking mechanism disposed to lock the intermediate housing ring to the housing, wherein releasing the second releasable locking mechanism permits the first door to be approximated with the second door to move the door gap to the closed configuration, and the door gap to be moved downstream of the radial port in the closed configuration.

4. The wellbore fluid communication tool of claim 1, wherein the seal assembly further comprises a second housing port seal, which is disposed on downstream side of the radial port.

5. The wellbore fluid communication tool of claim 1, wherein the outer sleeve assembly further includes a first sleeve collar and a second sleeve collar, which are positioned below the first door and the second door.

6. The wellbore fluid communication tool of claim 5, wherein the second sleeve collar is affixed to the housing.

7. The wellbore fluid communication tool of claim 5, wherein the first sleeve collar is slidably disposed about the inner mandrel below the second door and above the second sleeve collar.

8. The wellbore fluid communication tool of claim 1, wherein the outer sleeve assembly further comprises a plurality of lugs that are operable to selectively engage a plurality of grooves and a lower mandrel shoulder of the inner mandrel.

9. The wellbore fluid communication tool of claim 1, further comprising a second seat assembly disposed within the inner mandrel near the lower mandrel shoulder.

10. A wellbore fluid communication tool, the tool comprising:

a housing having a central passage therethrough extending between a first end and a second end and defined along a longitudinal axis, the housing including at least one radial port;

a seal assembly disposed along the housing along the central passage, the seal assembly including a first housing port seal between the radial port and the first end of the housing;

an outer sleeve assembly disposed radially within the housing along the central passage, the sleeve assembly having first and second doors abutting one another to define a door gap in a first closed configuration, the door gap positioned between the seal assembly and the first end of the housing when the first and second doors are in the first closed configuration;

an inner mandrel having a radial orifice, the inner mandrel disposed radially within the outer sleeve assembly so that the radial orifice is adjacent the door gap, the inner mandrel having a plurality of grooves defined therealong;

a first releasable locking mechanism securing the outer sleeve assembly to the housing in the first locked position;

a first releasable attachment mechanism extending from the outer sleeve assembly to engage a groove of the inner mandrel to secure the inner mandrel to the outer sleeve assembly in the first position; and a first seat assembly disposed within the outer sleeve assembly and coupled to the inner mandrel to move axially together with the outer sleeve assembly and the inner mandrel in response to a first object landing in the first seat assembly, the outer sleeve assembly and the inner mandrel axially slidable within the housing with the door gap in the first closed configuration to a second position where the door gap is positioned between the seal assembly and the second end of the housing when the first releasable locking mechanism is released; and the first releasable attachment mechanism operable to release the groove of the inner mandrel withe the outer sleeve assembly at the second position to permit the first and second door to separate to define an open configuration of the door gap.

11. The wellbore fluid communication tool of claim 10, wherein the outer sleeve assembly includes a shoulder and the wellbore fluid communication tool further comprises an intermediate housing ring secured to the housing by a second releasable locking mechanism, the housing ring spaced apart from the outer sleeve shoulder when the tool is in the first position.

12. The wellbore fluid communication tool of claim 10, wherein the first releasable locking mechanism is a shear pin.

13. The wellbore fluid communication tool of claim 10, wherein the seal assembly includes a second housing port seal between the radial port and the first end of the housing.

14. The wellbore fluid communication tool of claim 10, wherein the outer sleeve assembly further includes a first sleeve collar and a second sleeve collar which are positioned below the first door and the second door.

15. A method for conducting cementing operations in a wellbore, the method comprising:

positioning a cementing tool in a wellbore at a first location spaced apart from a second location that is downstream of the first location;

conducting cementing operations at the second location;

following the cementing operations at the second location, applying a first pressure to the cementing tool to collectively translate substantially abutting first and second doors together such that a door gap defined between the first and second doors is translated in a closed configuration across a seal of the cementing tool;

applying a second pressure to the cementing tool to (i) align an orifice in an inner mandrel of the cementing tool disposed radially within the first and second doors with a port in a housing of the cementing tool disposed radially outside the first and second doors and (ii) subsequent to collectively translating the first and second doors in a closed configuration across the seal, individually translate the second door away from the first door, thereby establishing fluid communication between the orifice and the port; and conducting cementing operations at the second location through the orifice, between the first and second doors and through the port.

16. The method of claim 15, wherein cementing operations at the second location comprises directing cementing fluids through the aligned orifice and port in order to deliver cementing fluids to an annulus about the cementing tool.

17. The method of claim 15, wherein the first pressure is applied by landing an object on a seat within the cementing tool and applying pressure to the object until a shear mechanism ruptures, allowing the first and second doors to collectively translate.

18. The method of claim 15, wherein conducting cementing operations at the second location comprises driving the landed object from a seat and passing cementing fluids through the seat to the aligned orifice and port.

19. A method for establishing fluid communication in a wellbore comprising:

positioning a wellbore fluid communication tool in a wellbore, the wellbore fluid communication tool including a tubular housing having a radial port defined therein, an inner mandrel disposed radially within the housing and defining a radial orifice therein and a sleeve including first and second doors disposed radially between the tubular housing and the inner mandrel;

applying a first pressure to the tool to collectively translate the first and second doors of the tool such that a door gap defined between the first and second doors is translated in a closed configuration across a seal; and applying a second pressure to wellbore fluid communication tool to (i) align the orifice with the port and (ii) move the second door away from the first door, thereby establishing fluid communication between the orifice and the port through the door gap in an open configuration.

20. The method of claim 19, wherein the first pressure is applied by landing an object in a seat of the tool and applying the first pressure to the object until a shear pin release the first and second doors from a first closed position, allowing the doors to collectively translate to a second closed position.

* * * * *